United States Patent [19]

Price

[11] Patent Number: 5,049,858

[45] Date of Patent: Sep. 17, 1991

[54] INTRUSION DETECTION SYSTEM

[75] Inventor: Melvin L. Price, Huntsville, Ala.

[73] Assignee: Physitron, Inc., Huntsville, Ala. ; a part interest

[21] Appl. No.: 512,476

[22] Filed: Apr. 23, 1990

[51] Int. Cl.[5] ..... G08B 13/18

[52] U.S. Cl. ..... 340/552; 342/27; 364/576

[58] Field of Search ..... 340/552, 825.64, 825.69, 340/825.72, 566, 665; 342/27; 364/576

[56] References Cited

U.S. PATENT DOCUMENTS

| | | | |
|---|---|---|---|
| 3,733,602 | 5/1973 | Cuckler et al. | 340/552 X |
| 3,832,704 | 8/1974 | Kardashian | 340/665 X |
| 3,940,733 | 2/1976 | Johnson et al. | 340/566 X |
| 4,091,367 | 5/1978 | Harman | 340/552 |
| 4,107,660 | 8/1978 | Chleboun | 340/566 |
| 4,197,537 | 4/1980 | Follen et al. | 340/552 X |
| 4,443,792 | 4/1984 | Pidgeon et al. | 340/552 |
| 4,811,308 | 3/1989 | Michel | 340/541 X |
| 4,879,544 | 11/1989 | Maki et al. | 340/552 |

*Primary Examiner*—Glen R. Swann, III

*Assistant Examiner*—Thomas J. Mullen, Jr.

*Attorney, Agent, or Firm*—John C. Garvin, Jr.; Harold W. Hilton

[57] ABSTRACT

A pulsed conductivity sensor intrusion detection device which uses the conduction of short electrical pulses on or near the surface and the immediately adjoining air above the surface. An intruder causes the propagated signal to change which is sensed by the Pulsed Conductivity Sensor (PCS) and produces an alarm. A path is protected by placing a transmitter and a receiver on either side with the protected region between them. An area is protected by placing transmitter and receivers around the periphery of the area. Pulses are sent from the transmitter to the receiver through the surface and the air immediately above it. The receiver sends the signal to an analyzer where the frequency/amplitude spectrum is determined using Fourier Transform techniques. Pulses are sent ten or more times per second and each is analyzed. By comparing sequential pulses, any change will be detected. Signatures for different subjects have been determined and are used to detect when a human intrusion occurs.

8 Claims, 4 Drawing Sheets

INTRUSION DETECTION SYSTEM

TECHNICAL FIELD

This invention is related generally to an intrusion detection system and more specifically to such a system which detects changes in ground conductivity to signal when an intruder has entered a secure area.

BACKGROUND OF THE INVENTION

Intrusion detection systems may be used in industry as a means of protection of proprietary interests, trade secrets, etc. from their competitors, for protection of their products from theft, etc. Some typical intrusion detection systems for detecting when an object or person has crossed into a selected area require a great amount of site preparation. Some such systems also require line of sight operation, fences, co-axial cables and highly trained technicians to set up and operate the system.

There are many other uses for intrusion detection devices other than those mentioned in relation to industry. The military services, for example, have invested heavily in intrusion detection systems which are used both by tactical and strategic nuclear forces. For example, in fixed, peacetime nuclear weapon storage sites, the incorporation of sophisticated sensor and data processing systems has been used to significantly improve security. On the other hand, tactical Theater Nuclear Force (TNF) units are designed to operate as mobile, constantly shifting forces during transition and wartime situations. Daily moves of a nuclear capable unit provide a high degree of survivability and two or more moves per day would not be unreasonable for certain high risk TNF units. Unfortunately, the intrusion protection systems currently available do not provide sufficient protection against the small, slow moving, stealth-like personnel threat posed against disposed TNF units.

Additionally current intrusion detection sensors are limited in sensitivity, have excessive false alarm rates, cannot distinguish between animal and people and use physical principles including pressure sensing, acoustic, magnetic, seismic, infrared, radar, and electric wires.

SUMMARY OF THE INVENTION

It is an object of the present invention, therefore, to provide an intrusion detection system which will overcome the above noted deficiencies of current intrusion detection systems.

It is another object of the present invention, therefore, to provide such an intrusion detection system which is mobile and which may be set up and recovered in a rapid and facile manner.

It is still another object of the present invention to provide such an intrusion detection system which is rugged and easy to maintain.

It is a further object of the present invention to provide such an intrusion detection system which is capable of day/night and all weather operation.

These and other objects of the present invention are achieved by the provision of an intrusion detection system which uses pulsed RF energy conducted along the ground surface to immediately detect any object or person crossing a selected area. The sensing element is the ground itself since ground conductivity (resistance $-^{1}$) changes when compressed by the weight of an object. The sensor system is substantially transparent to detection by hostile forces. Installation, checkout, calibration and operation of the sensor system is accomplished by a small team in a small amount of time.

DESCRIPTION OF THE PREFERRED EMBODIMENT

Figure 1:
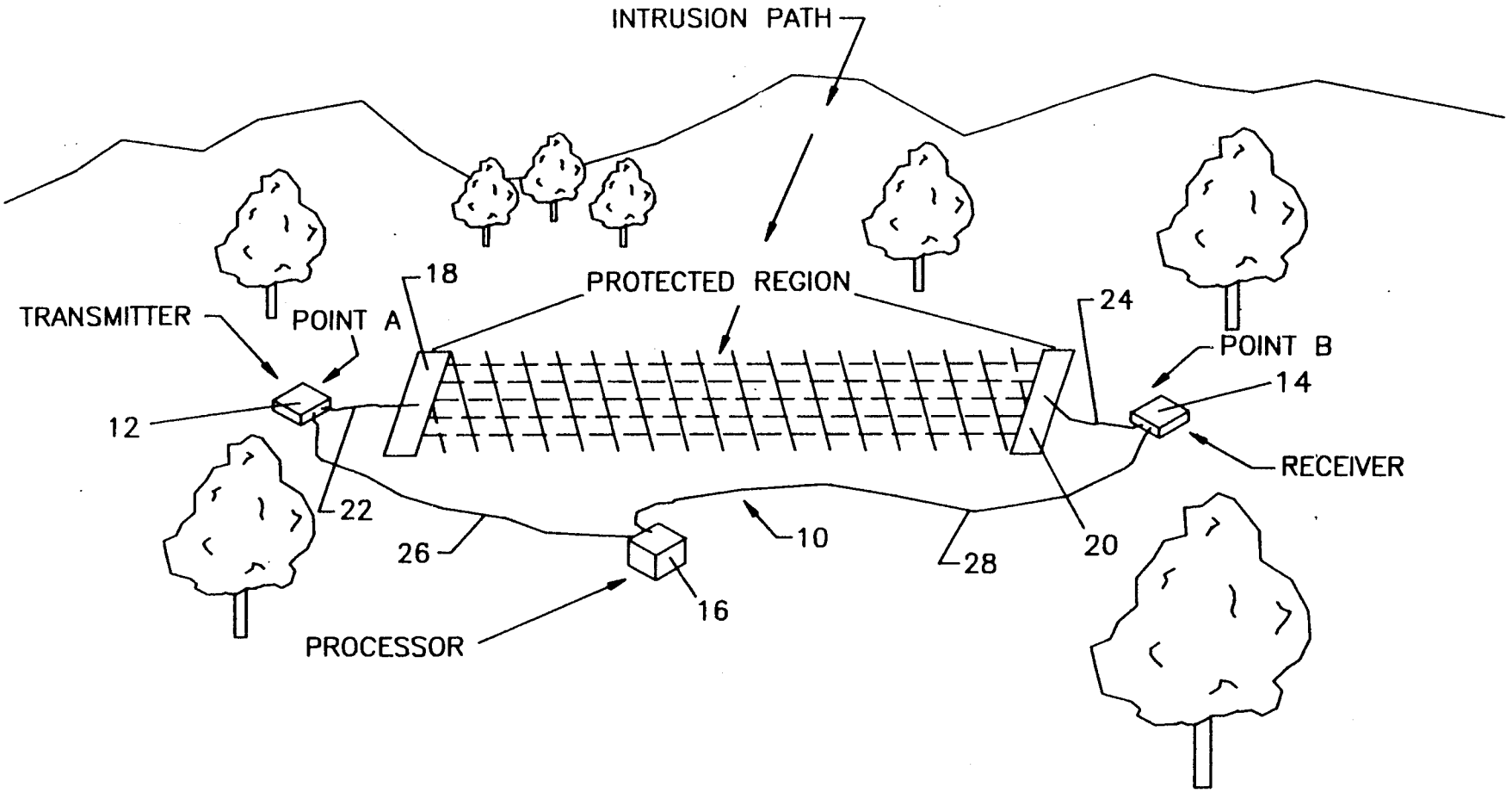
FIG. 1 is a diagrammatic view of the intrusion detection system of the present invention.

As seen in FIG. 1 an intrusion detection system 10 is provided to sense changes in ground conductivity to detect intruders. A pulsed signal is generated in a transmitter 12 at point A and coupled to the ground at surface level. For frequencies in the UHF band and for typical ground conductivities around $1\times10^{-2}$ mho/m, the skin depth is given by the following expressions:

$$\delta = \sqrt{\frac{2}{\sigma\omega\mu}} \sim 0.5 \text{ meter}$$

Where $\delta$=ground conductivity, $\omega$=frequency and $\mu$=magnetic permeability of the ground.

Figure 3:
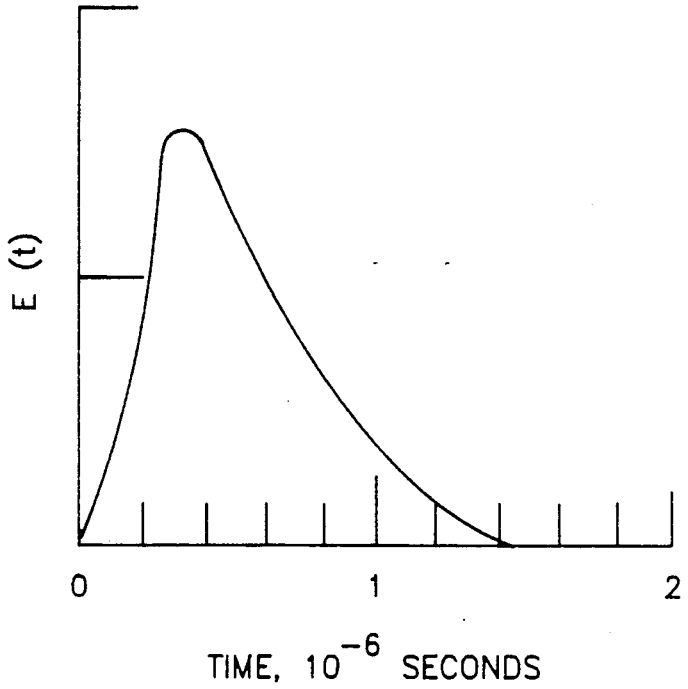
FIG. 3 is a diagrammatic view of a typical pulsed signal provided in the signal generating device used in the intrusion detection system of the present invention.
Figure 4:
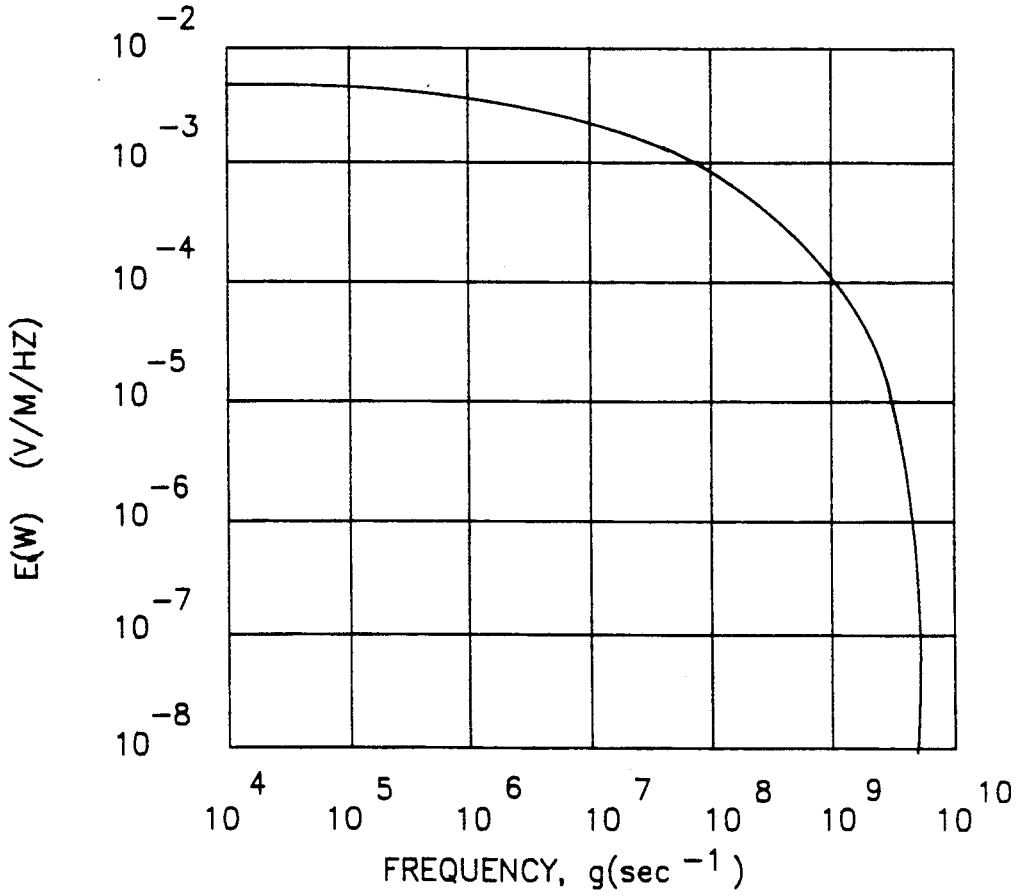
FIG. 4 is a diagrammatic view of the Fourier Transform illustrating the frequency/amplitude relation of the pulse of FIG. 3.

Therefore, the pulsed signal will propagate along or near the surface to a receiver 14 mounted at point B. By using a pulsed signal as illustrated in FIG. 3, a frequency spectrum is obtained which is not obtainable using a CW signal. FIG. 4 illustrates the frequency spectrum for the pulse as determined by taking its Fourier Transform.

As seen in FIG. 1, the system 10 includes a transmitter 12, a receiver 14, and a processor 16. A pair of spaced plates 18 and 20 are shown positioned at the edges of the protected area and are respectively connected by cables 22 and 24 to the transmitter and receiver. The plates and cables may be imbedded in the ground. Electrical cables 26 and 28 which may also be imbedded in the ground for concealment, extends from the transmitter and receiver respectively to processor 16.

Figure 2:
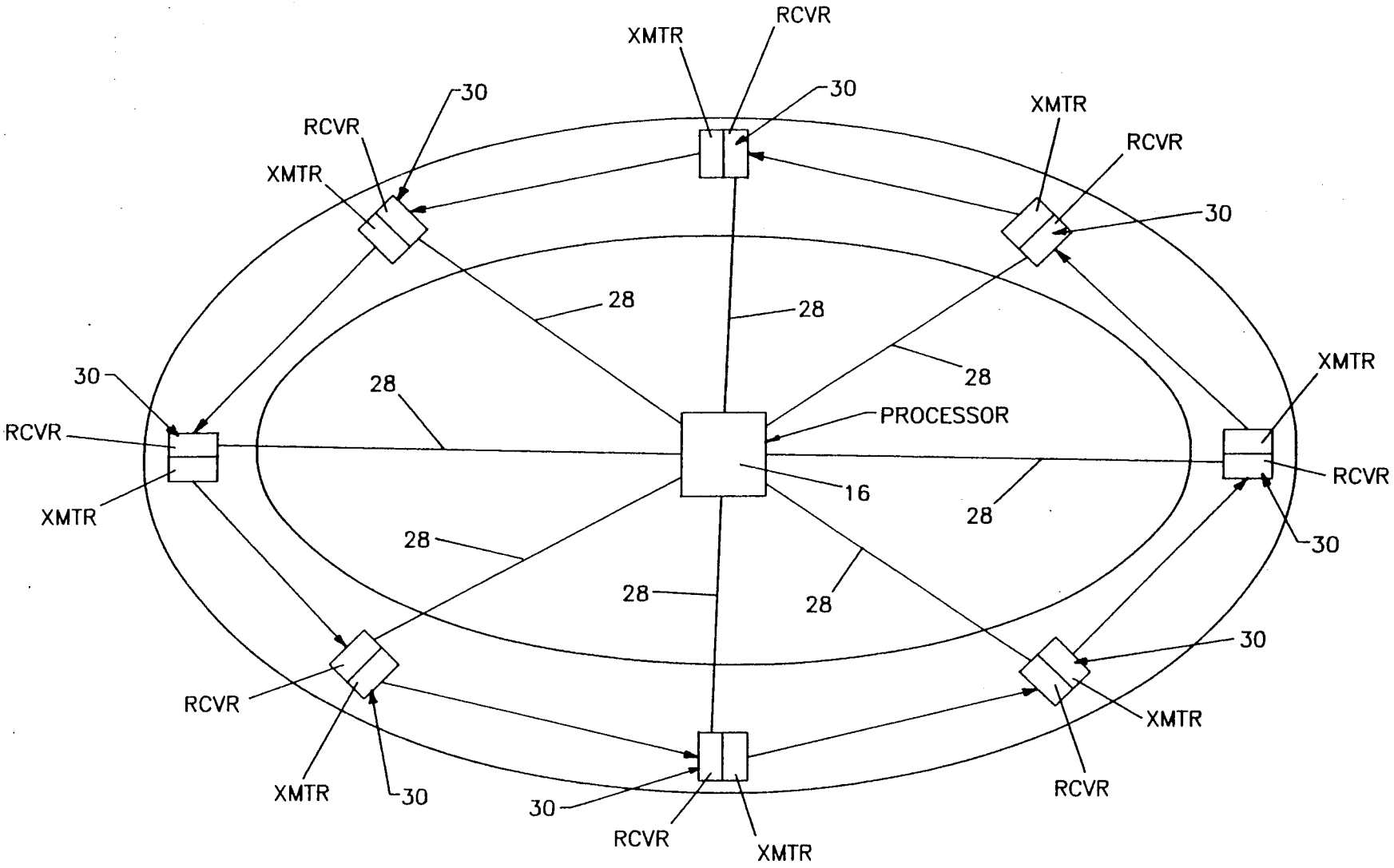
FIG. 2 is another embodiment of the intrusion detection system the present invention.

A second embodiment of the invention is illustrated in FIG. 2 wherein like reference numerals refer to like parts. As seen in FIG. 2, processor 16 is shown to be mounted within the boundary of the protected area and a plurality of transmitter receivers mounted in small electronic boxes 30 are spaced around the periphery of the area to be protected. The receiver in box 30 is connected to the processor by cable 28. The cable and electronic boxes are easily concealable and there are no cables or physical connections between adjoining boxes. In operation, an RF pulse is generated in the transmitter and conducted through the ground along or near the surface to the receiver. The processor 16 performs a spectrum of the signal using a Fast Fourier Transform (FFT) algorithm or equivalent.

Figure 5:
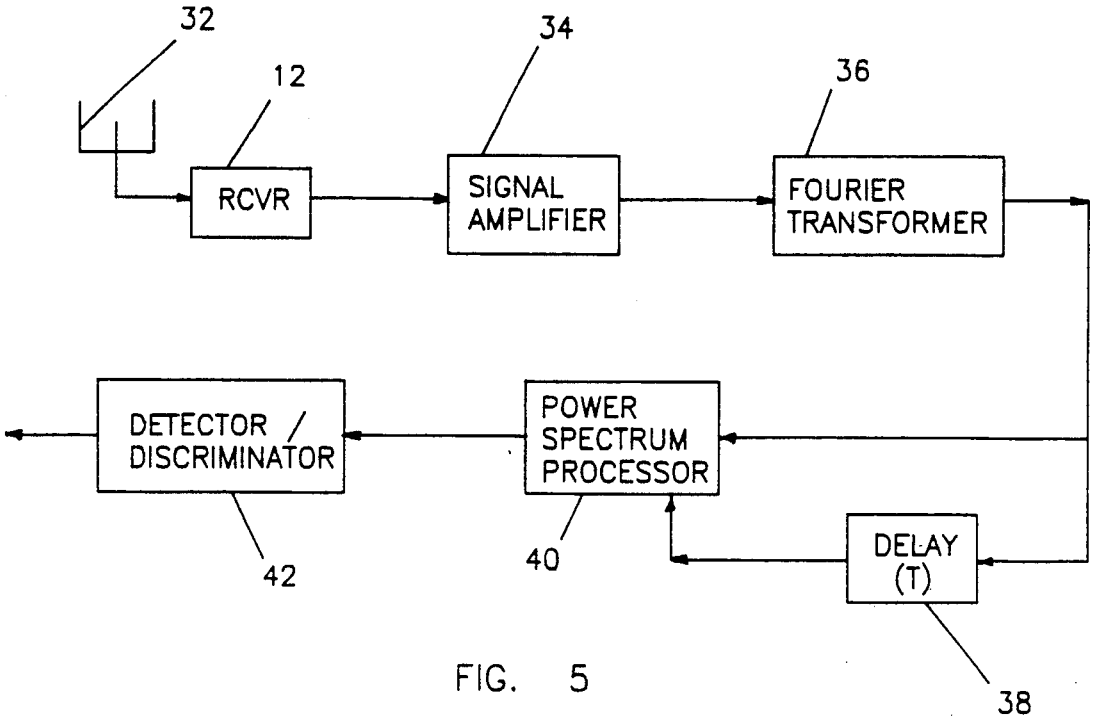
FIG. 5 is a block diagram of a processing unit for the pulsed conductivity sensor of the present invention.

One system for processing the pulsed output of the conductivity sensor system of the present invention is shown in FIG. 5. As seen in FIG. 5, receiver 12 receives an input signal 32 which is amplified in amplifier 34 and is Fourier transformed by circuit 36 where its frequency spectrum versus amplitude relation is determined. The signal passes through a delay circuit 38 into a power spectrum processor 40 and then into a detector/discriminator 42. As can be seen, changes in the received signal are detected by examination of the power spectrum values of two consecutive pulses.

As seen from the above equation, the skin depth will decrease for increasing frequency, i.e., $$\delta \propto \frac{1}{\sqrt{\omega}}.$$

Thus, we would expect that changes in ground conductivity versus depth will be reflected as changes in the frequency/amplitude relation. For large, heavy bodies, the ground conductivity change will occur from the surface down to a deeper depth than for light objects. The amount of change obviously depends on the soil density, weight of object, pulse characteristics and other parameters.

It is to be understood that the transmitter includes a pulse generator capable of producing electrical pulses with an amplitude of 1 kv or more, an adjustable pulse width of between 5 to 50 ns, a risetime of less than 1 ns and a repetition rate of 10 pulses per second or more. Two coupling antennas for transmitting and receiving the pulses are required along with an analyzer which takes the contents, compares successive pulses with a specified reference pulse, and determines when changes between pulses are due to intruders.

Figure 6:
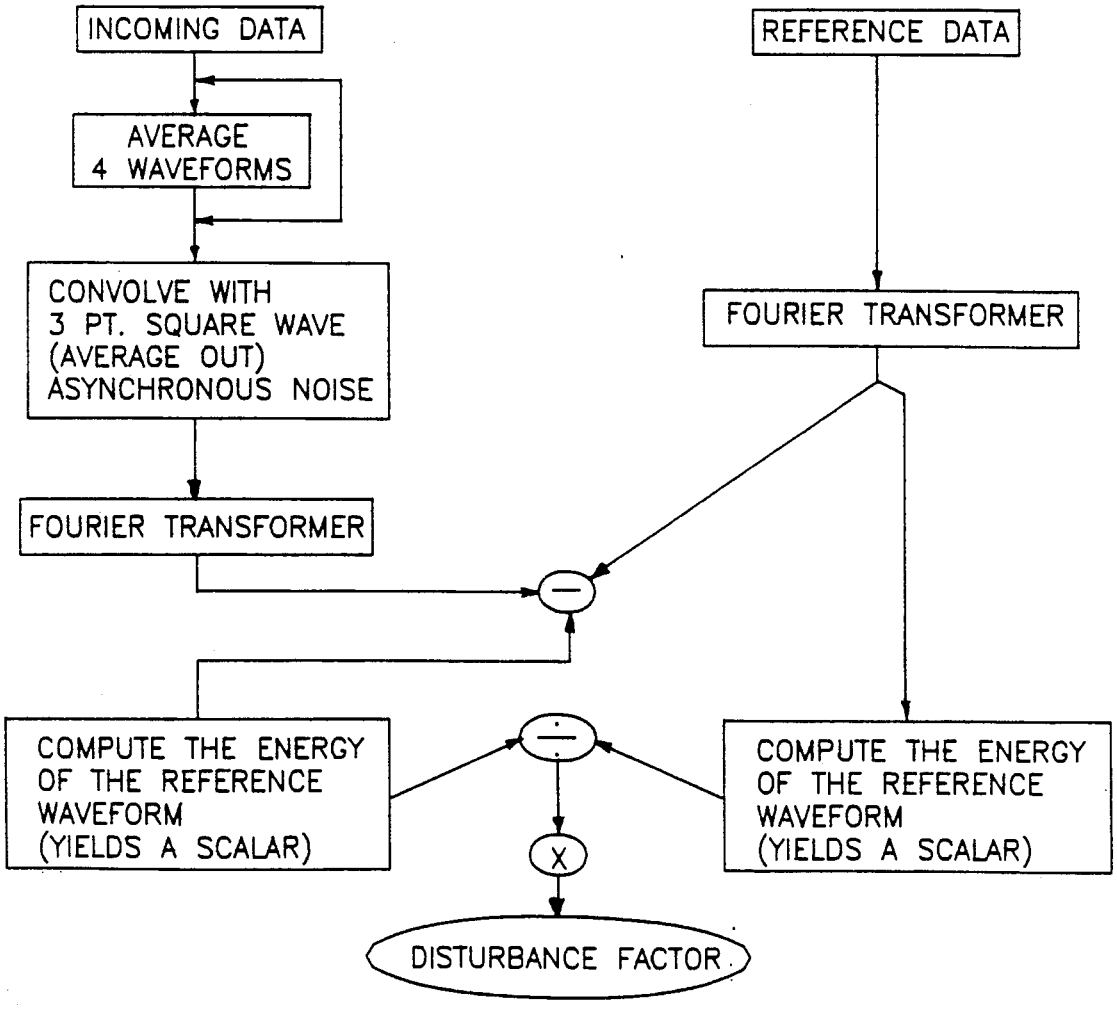
FIG. 6 is a block diagram illustrating the signal processing used in the processing unit of the intrusion detection system of the present invention.

The analyzer may be similar to the Universal Waveform Analyzer, Model 6100, manufactured by Analogic Data Precision, 16 Electronic Avenue, Danvers, MA 01923. FIG. 6 diagrammatically illustrates the signal processing procedure in the analyzer.

I claim:

1. An intrusion detection system for use in an area to be protected comprising:

a transmitter for transmitting pulses of RF energy, said pulses disposed for conduction on or near the surface of said area to be protected;

a receiver disposed in spaced relation with said source of electrical pulses to receive said electrical pulses therefrom; and processing means disposed for receiving sequential electrical signals corresponding to said electrical pulses and for determining the frequency/amplitude spectrum of said electrical signals and comparing said sequential signals to detect any changes in said signals, said processing means including Fourier Transform means for determining said frequency/amplitude spectrum of said electrical signals; and, said transmitter disposed for producing electrical pulses with an amplitude of 1 kv and above, an adjustable pulse width of between 5 to 50 ns, a risetime of less than 1 ns and a repetition rate of 10 or more pulses per second.

2. An intrusion detection system of ruse in an area to be protected comprising:

a transmitter for transmitting successive pulses of RF energy;

a receiver for receiving said successive pulses of RF energy;

sensing means forming an electrically conductive path for propagating said RF energy between said transmitter and said receiver, said sensing means being defined as the ground, the conductivity of which changes responsive to compression thereof caused by the weight of said intruder; and processing means disposed for receiving said successive pulses of RF energy from the ground and for analyzing said successive pulses of RF energy for determining changes in property of the propagation path responsive to intrusion into said area.

3. An intrusion detection system as set forth in claim 2 including a plurality of said transmitters and said receivers disposed throughout said area, and means electrically connecting each said receiver to said analyzer.

4. An intrusion detection system as set forth in claim 3 wherein said means for connecting each said receiver is an electrical cable.

5. An intrusion detection system as set forth in claim 4 wherein said processing means comprises an amplifier for amplifying said signals received by said receiver, Fourier Transform means for receiving said amplified signal and determining the frequency/amplitude spectrum thereof, power spectrum means for receiving said Fourier transformed signals and for examining the power spectrum difference of two consecutive said electrical pulses, delay circuit means connected between said Fourier Transform means and said power spectrum means; and, detector discriminator means for receiving electrical signals from said power spectrum means.

6. An intrusion detection system as set forth in claim 5 including a first electrically conductive member positioned adjacent a predetermined path, said first electrically conductive member disposed in engagement with the ground surface and electrically connected to said transmitter for directing said electrical signal onto said ground surface.

7. An intrusion detection system as set forth in claim 6 including a second electrically conductive member positioned adjacent said predetermined path, said second electrically conductive member disposed in engagement with the ground surface and electrically connected to said receiver for directing said transmitted signals thereto; and, means for connecting said receiver to said processing means for directing said signals thereto.

8. An intrusion detection system as set forth in claim 5 wherein a said transmitter and a said receiver is mounted in a common enclosure, a plurality of said enclosures being positioned around the periphery of the area to be protected and oriented so that the transmitter of one enclosure transmits said electrical signals to the receiver of an adjacent enclosure whereby said transmitted and received signals are made to encompass the protected area.

* * * * *